US010837744B1

(12) United States Patent
McIntosh

(10) Patent No.: US 10,837,744 B1
(45) Date of Patent: Nov. 17, 2020

(54) SHOT SHELL SYSTEM AND METHOD

(71) Applicant: Donald McIntosh, Gaffney, SC (US)

(72) Inventor: Donald McIntosh, Gaffney, SC (US)

( * ) Notice: Subject to any disclaimer, the term of this patent is extended or adjusted under 35 U.S.C. 154(b) by 0 days.

(21) Appl. No.: 16/405,191

(22) Filed: May 7, 2019

(51) Int. Cl.
*F42B 7/04* (2006.01)

(52) U.S. Cl.
CPC ..... *F42B 7/046* (2013.01)

(58) Field of Classification Search
CPC ..... F42B 7/046
USPC ..... 102/448
See application file for complete search history.

(56) References Cited

U.S. PATENT DOCUMENTS

| | | | | |
|---|---|---|---|---|
| 4,760,793 | A * | 8/1988 | Herring, III | F42B 7/04 102/451 |
| 5,264,022 | A | 11/1993 | Haygarth et al. | |
| 6,202,561 | B1 | 3/2001 | Head et al. | |
| 6,367,388 | B1 * | 4/2002 | Billings | F42B 7/04 102/453 |
| 7,765,933 | B2 | 8/2010 | Poore et al. | |
| 8,171,849 | B2 * | 5/2012 | Amick | F42B 7/046 102/448 |
| 8,807,040 | B2 | 8/2014 | Menefee, III | |
| 2005/0211125 | A1 * | 9/2005 | Amick | C22C 19/03 102/448 |
| 2009/0114113 | A1 * | 5/2009 | Poore | F42B 7/046 102/460 |
| 2010/0175575 | A1 | 7/2010 | Amick | |
| 2011/0017090 | A1 * | 1/2011 | Menefee, III | F42B 7/02 102/448 |
| 2011/0107935 | A1 * | 5/2011 | Authement, Sr. | F42B 12/40 102/458 |
| 2011/0108593 | A1 | 8/2011 | Richardson et al. | |
| 2013/0145951 | A1 * | 6/2013 | Nauman | F42B 7/04 102/448 |

FOREIGN PATENT DOCUMENTS

| | | | |
|---|---|---|---|
| EP | 1037006 | A1 | 9/2000 |

OTHER PUBLICATIONS product sheet for TPS Series Premium Field Wads by Ballistic Products, Inc (BPI) [all pages] (Year: 2016).*

* cited by examiner

*Primary Examiner* — Samir Abdosh
(74) *Attorney, Agent, or Firm* — Southeast IP Group LLC; Thomas L. Moses

(57) ABSTRACT

A shot shell includes a cartridge (also referred herein as a 'hull'), a primer, gunpowder, a tungsten propulsion system wadding, shot pellets having a first size, and shot pellets having a second size that is larger than the first size, and a 5-8 star crimp on an upper portion of the plastic cartridge. It has been found that there are advantages to loading smaller shot (preferably 3 shot or 4 shot) first, and then loading larger shot (preferably 1 shot or 2 shot) so that the larger shot leaves the cartridge first when the shot shell is fired. In a preferred embodiment, the cartridge contains 40% to 60% large shot, and the remainder of shot pellets in the cartridge is smaller shot. In an alternate embodiment, the large shot may be loaded first, and the smaller shot loaded last, so that the smaller shot leaves the shot shell first.

11 Claims, 2 Drawing Sheets

SHOT SHELL SYSTEM AND METHOD

BACKGROUND OF THE INVENTION

A shotgun shell (also referred to hereinafter as "shot shell" or "shotshell") is a self-contained cartridge often loaded with multiple metallic "shot," which are small, generally spherical projectiles. The shells consist of a paper or plastic tube mounted on a brass base holding a primer. The shot is typically contained in a small container inside the shell casing. Shot has traditionally been made of lead, but steel, tungsten or bismuth is frequently used due to restrictions on lead.

Shot Shell Construction

Modern shotgun shells typically consist of a plastic case, with the base covered in a thin brass plated steel covering. Some companies have produced what appear to be all-plastic shells, although in these there is a small metal ring cast into the rim of the shell to provide strength.

The base of the shot shell is fairly thick to hold the large shotgun primer, which is longer than primers used for rifle and pistol ammunition. Modern smokeless powders are far more efficient than the original black powder used in shotgun shells, so very little space is actually taken by powder; shotguns use small quantities of double base powders, equivalent to quick-burning pistol powders, with up to 50% nitroglycerin. After the powder comes the wadding or wad. The primary purpose of a wad is to prevent the shot and powder from mixing, and to provide a seal that prevents gas from blowing through the shot rather than propelling it. The wad design may also encompass a shock absorber and a cup that holds the shot together until it is out of the barrel.

A modern wad consists of three parts, the powder wad, the cushion, and the shot cup, which may be separate pieces or be one part. The powder wad acts as the gas seal (known as obturation), and is placed firmly over the powder; it may be a paper or plastic part. The cushion comes next, and it is designed to compress under pressure, to act as a shock absorber and minimize the deformation of the shot; it also serves to take up as much space as is needed between the powder wad and the shot. Cushions are almost universally made of plastic with crumple zones, although for game shooting in areas grazed by farm stock or wildlife biodegradable fiber wads are often preferred. The shot cup is the last part of the shell, and it serves to hold the shot together as it moves down the barrel. Shot cups typically have slits on the sides so that they peel open after leaving the barrel, allowing the shot to continue on in flight undisturbed. Shot cups, where used, are also almost universally plastic. The shot fills the shot cup (which must be of the correct length to hold the desired quantity of shot), and the shotgun shell is then crimped, or rolled closed.

Shot Pellets

Shot shells are loaded with different sizes of shot depending on the target. For skeet shooting, a small shot such as a No. 8 or No. 9 is typically used, because the range is short and a high density pattern is desirable. Trap shooting requires longer shots, and so a larger shot, usually #7% is used. For hunting game, the range and penetration needed to assure a clean kill is considered. Shot loses its velocity very quickly due to its low sectional density and ballistic coefficient. Small shot, like that used for skeet and trap, will have lost all appreciable energy by around 100 yards (91 m), which is why trap and skeet ranges can be located in relatively close proximity to inhabited areas with negligible risk of injury to those outside the range.

Birdshot sizes are numbered similar to shotgun gauges. The smaller the number, the larger the shot. For hunting, shot size must be chosen not only for the range, but also for the game. The shot must reach the target with enough energy to penetrate to a depth sufficient to kill the game. Lead shot is still the best ballistic performer, but environmental restrictions on the use of lead, especially with waterfowl, require steel, bismuth, or tungsten composites. Steel, being significantly less dense than lead, requires larger shot sizes, but is a good choice when lead is not legal and cost is a consideration.

Larger sizes of shot, large enough that they must be carefully packed into the shell rather than simply dumped or poured in, are called "buckshot" or just "buck". Buckshot is used for hunting medium to large game, as a tactical round for law enforcement and military personnel, and for personal self-defense.

Spread and Patterning

Most modern sporting shotguns have interchangeable choke tubes to allow the shooter to change the spread of shot that comes out of the gun. In some cases, it is not practical to do this; the gun might have fixed choke, or a shooter firing at receding targets may want to fire a wide pattern immediately followed by a narrower pattern out of a single barrelled shotgun. The spread of the shot can also be altered by changing the characteristics of the shell.

Narrower Patterns

In order to provide a narrower pattern, buffering material, such as granulated plastic, sawdust, or similar material can be mixed with the shot to fill the spaces between the individual pellets. When fired, the buffering material compresses and supports the shot, reducing the deformation the shot pellets experience under the extreme acceleration. Antimony-lead alloys, copper plated lead shot, steel, bismuth, and tungsten composite shot all have a hardness greater than that of plain lead shot, and will deform less as well. Reducing the deformation will result in tighter patterns, as the spherical pellets tend to fly straighter. One improvised method for achieving the same effect involves pouring molten wax or tar into the mass of shot. Another is a partial ring cut around the case intended to ensure that the shot comes out tightly bunched along with the portion of the case forward of the cut, creating a 'cut-shell'.

Wider Patterns

Shooting the softest possible shot will result in more shot deformation and a wider pattern. Spreader wads are wads that have a small plastic or paper insert in the middle of the shot cup, usually a cylinder or "X" cross-section. When the shot exits the barrel, the insert helps to push the shot out from the center, opening up the pattern. Intentionally deformed shot (hammered into ellipsoidal shape) or cubical shot will also result in a wider pattern, much wider than spherical shot, with more consistency than spreader wads. Hunting loads that use either spreaders or non-spherical shot are usually called "brush loads", and are favored for hunting in areas where dense cover keeps shot distances very short.

Spread

Most shotgun shells contain multiple pellets in order to increase the likelihood of a target being hit. A shotgun's shot spread refers to the two-dimensional pattern that these projectiles (or shot) leave behind on a target. Another less important dimension of spread concerns the length of the in-flight shot string from the leading pellet to the trailing one. The use of multiple pellets is especially useful for hunting small game such as birds, rabbits, and other animals that fly or move quickly and can unpredictably change their direction of travel. However, some shotgun shells only contain one metal shot, known as a slug, for hunting large game such as deer.

As the shot leaves the barrel upon firing, the three-dimensional shot string is close together. But as the shot moves farther away, the individual pellets increasingly spread out and disperse. Because of this spreading effect, the effective range of a shotgun, when firing a multitude of shot, is limited to approximately 20 to 50 meters (22 to 55 yards). To control this effect, shooters may use a constriction within the barrel of a shotgun called a choke. The choke, whether selectable or fixed within a barrel, effectively reduces the diameter of the end of the barrel, forcing the shot even closer together as it leaves the barrel, thereby increasing the effective range. The tighter the choke, the narrower the end of the barrel. Consequently, the effective range of a shotgun is increased with a tighter choke, as the shot column is held tighter over longer ranges. Hunters or target shooters can install several types of chokes, on guns having selectable chokes, depending on the range at which their intended targets will be located. For fixed choke shotguns, different shotguns or barrels are often selected for the intended hunting application at hand. From tightest to loosest, the various choke sizes are: full choke, improved modified, modified, improved cylinder, skeet, and cylinder bore.

A hunter who intends to hunt an animal such as rabbit or grouse, knows that the animal will be encountered at a close range—usually within 20 m (22 yards), and will be moving very quickly. So, an ideal choke would be a cylinder bore (the loosest) as the hunter wants the shot to spread out as quickly as possible. If this hunter was using a full choke (the tightest) at 20 m (22 yards), the shot would be very close together and cause an unnecessarily large amount of damage to the rabbit, or, alternatively, a complete miss of the rabbit. This would waste virtually all of the meat for a hit, as the little amount of meat remaining would be overly-laden with shot and rendered inedible. By using a cylinder bore, this hunter would maximize the likelihood of a kill, and maximize the amount of edible meat. Contrarily, a hunter who intends to hunt geese knows that a goose will likely be approximately 50 m (55 yards) away, so, that hunter would want to delay the spread of the shot as much as possible by using a full choke. By using a full choke for targets that are farther away, the shooter again maximizes the likelihood of a kill, and maximizes the amount of edible meat. Also, this guarantees a swift and humane kill as the target would be hit with enough shot to kill quickly instead of only wounding the animal.

In some cases, however, such as waterfowl hunting, it would be desirable to provide a shot shell that includes the accuracy and range provided by the larger pellets, combined with the advantages of higher numbers of smaller pellets to hit a moving target. Various types of specialized shot shells have been developed over the years, and are set forth below. The references discussed below are hereby incorporated herein by reference, in their entireties:

U.S. Pat. No. 4,760,793 Multi-Range Shot Shell

This reference discloses a shot shell having a stratified payload of at least two different shot sizes, the larger diameter shot being closer to the mouth of the shell than the smaller diameter shot.

U.S. Pat. No. 5,264,022 Composite Shot

Lead free shotshell pellets are disclosed which consist essentially of an alloy of iron and 30 to 46% by weight of tungsten. The shotshells may include a plurality of pellet sizes, and the pellets may be coated substantially uniformly with a polymeric coating, resin, or lubricant.

U.S. Pat. No. 6,367,388 Ammunition Cartridge with Differently Packed Shotshell Wad Projectile Chambers An ammunition cartridge for use with a gun which cartridge has a shotshell wad defining a rear charge receiving chamber and at least two forward shot or other projectile receiving chambers wherein a forward shot receiving chamber is formed of a solid disk including a plurality of shot pellets or similar projectiles embedded in a hardened binder material and wherein a rear shot or similar projectile receiving chamber houses unbound shot pellets or projectiles.

U.S. Pat. No. 7,765,933 Shotshell with Shot Pellets Having Multiple Shapes

In at least one embodiment, a shotshell comprises a casing defining an internal chamber, a plurality of first shot pellets within the internal chamber and a plurality of second shot pellets within the internal chamber. The first shot pellets comprise a first shape and the second shot pellets comprise a second shape that is different from the first shape.

U.S. Pat. No. 8,171,849 Multi-Range Shotshells with Multimodal Patterning Properties and Methods for Producing the Same Shotshells are provided which are loaded with at least two different shot charges, at least one of said charges being comprised of shot pellets with short-range shape(s) and at least another of said charges being comprised of shot pellets with long-range shape(s). Said shotshells are thereby capable of producing shotgun patterns that are suitable for both short-range and long-range shooting.

U.S. Pat. No. 8,807,040 Cartridge for Multiplex Load

This disclosure relates to cartridges, including shotshell cartridges, for launching multiplex projectile loads that contain different sizes or types of projectiles, and methods of loading the cartridges. In one aspect, for example, the present cartridges can contain an obturating component adjacent the cartridge propellant, a first payload adjacent the obturating component, a separating component adjacent the first payload, and a second payload adjacent the separating component. Shotshells of this configuration in which the first (aft) payload comprises birdshot and the second (forward) payload comprises buckshot are particularly useful.

U.S. Patent Application 201000175575 Multi-Range Shotshells with Multimodal Properties and Methods for Producing the Same Shotshells are provided which are loaded with at least two different shot charges, at least one of said charges being comprised of shot pellets with short-range shape(s) and at least another of said charges being comprised of shot pellets with long-range shape(s). Said shotshells are thereby capable of producing shotgun patterns that are suitable for both short-range and long-range shooting.

U.S. Patent Application No 2001001062 Shotshell Having Pellets of Different Densities in Stratified Layers A shotshell comprised of shot pellets of different densities and materials which provide increased effectiveness at both close and long range. Preferably the pellets are disposed in longitudinally stratified layers, with the more dense pellets (18) located rearwardly of the pellets of lesser density (19). The pellets having the greater density (18) maintain a closer pattern at long range, because they are preferably made of tungsten which has a high density and are located rearwardly, while the pellets having lesser density (19) are preferably made of steel, describe a much wider pattern because of their lower density and forward location, and are therefore most effective at close range.

U.S. Application No. 2011085279 Shotshell with Combination Load for Personal Defense A shot shell comprising an elongate casing defining an internal chamber, a propellant located within said casing, and a shot load within the casing, the shot load comprising a plurality of disc-shaped projectiles, arranged in the casing so that the plane of each of the disc-shaped projectiles is generally perpendicular to the longitudinal axis of the casing, and a plurality of generally spherical projectiles disposed in the casing behind the generally disc-shaped projectiles.

BRIEF SUMMARY OF THE INVENTION

In accordance with one aspect of the invention, one embodiment of a shot shell includes a cartridge (also referred herein as a 'hull'), a primer, gunpowder, a tungsten propulsion system wadding, shot pellets having a first size, and shot pellets having a second size that is larger than the first size, and a 5-8 star crimp on an upper portion of the plastic cartridge. It has been found that there are advantages to loading smaller shot (preferably 3 shot or 4 shot) first, and then loading larger shot (preferably 1 shot or 2 shot) so that the larger shot leaves the cartridge first when the cartridge is fired. In a preferred embodiment, the cartridge contains 40% to 60% large shot, and the remainder of shot pellets in the cartridge is smaller shot.

In an alternate embodiment, the large shot may be loaded first, and the smaller shot loaded last, so that the smaller shot leaves the cartridge first.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
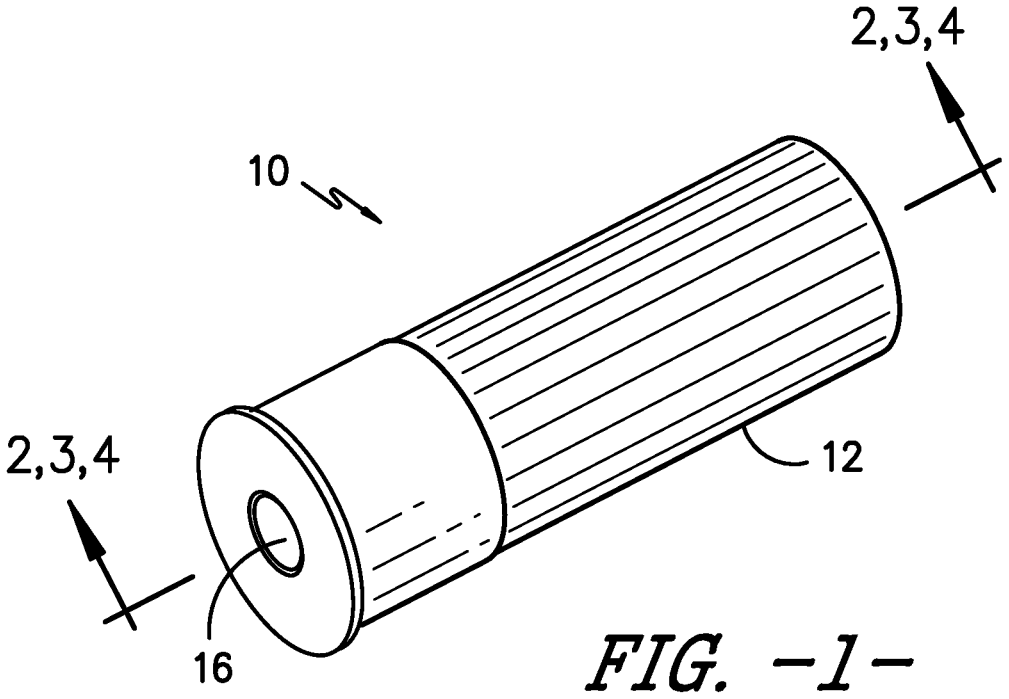
FIG. 1 is a perspective view of one embodiment of a shot shell in accordance with one aspect of the present invention.

The present invention includes, in a first embodiment, a shot shell 10 having a cartridge or hull 12 having a primer 16, and loaded with the following components, preferably in this order: ball propulsion powder 14 (also known as 'gunpowder'), a TPS (tungsten propulsion system) wad 18, smaller shot 20 and finally larger shot 22. The open end of the hull 12 is then preferably crimped, preferably with a 5-8 star crimp to close the shell 10, although other known methods for capping the open end of the hull 12 may be employed.

In a preferred embodiment, the hull 12 is made by a company called Cheddite, in Italy, although any suitable hull 12 may be used. In a preferred embodiment, the shell sizes may be in the range of 2¾ to 3½inch standard shells, although it should be understood that other suitable sizes may be utilized, as well. The ball propulsion powder 14 is preferably St. Marks 525 powder, and each shell should contain between 37 and 37.5 grams of the powder, although more or less powder may be used for different purposes, if necessary. It should be understood that other suitable types of ball propulsion powder may be used, as well.

Figure 2:
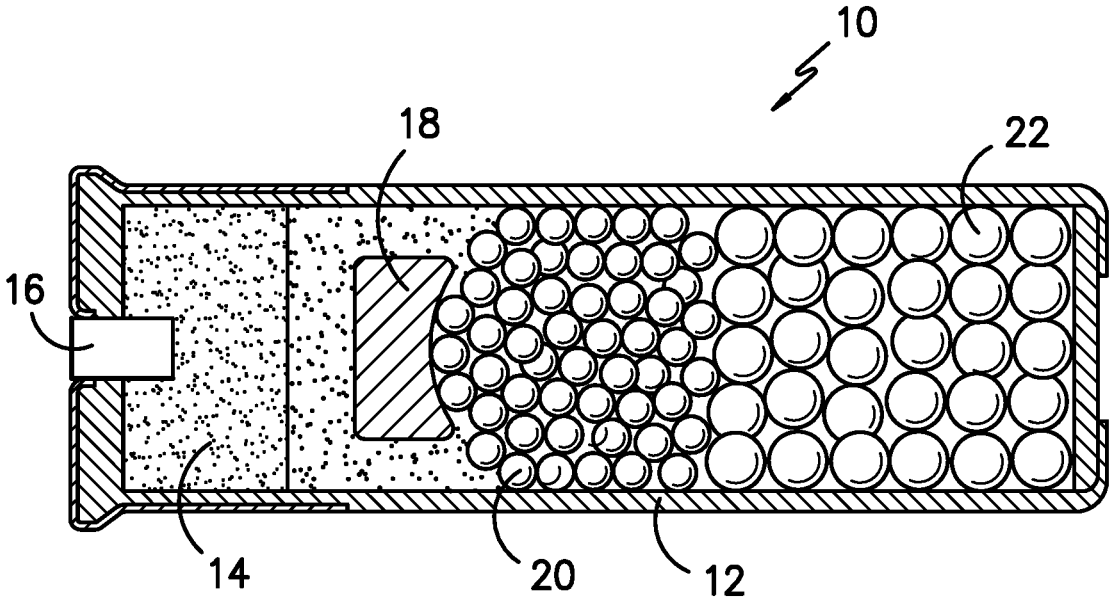
FIG. 2 is a cross sectional view along the lines 2-2 of FIG. 1, wherein the shot shell includes a hull, a primer, gunpowder, a wad, smaller shot pellets positioned adjacent the wad, and larger shot pellets adjacent the smaller shot pellets, wherein the larger shot pellets exit the hull before the smaller shot pellets when the shot shell is fired.
Figure 3:
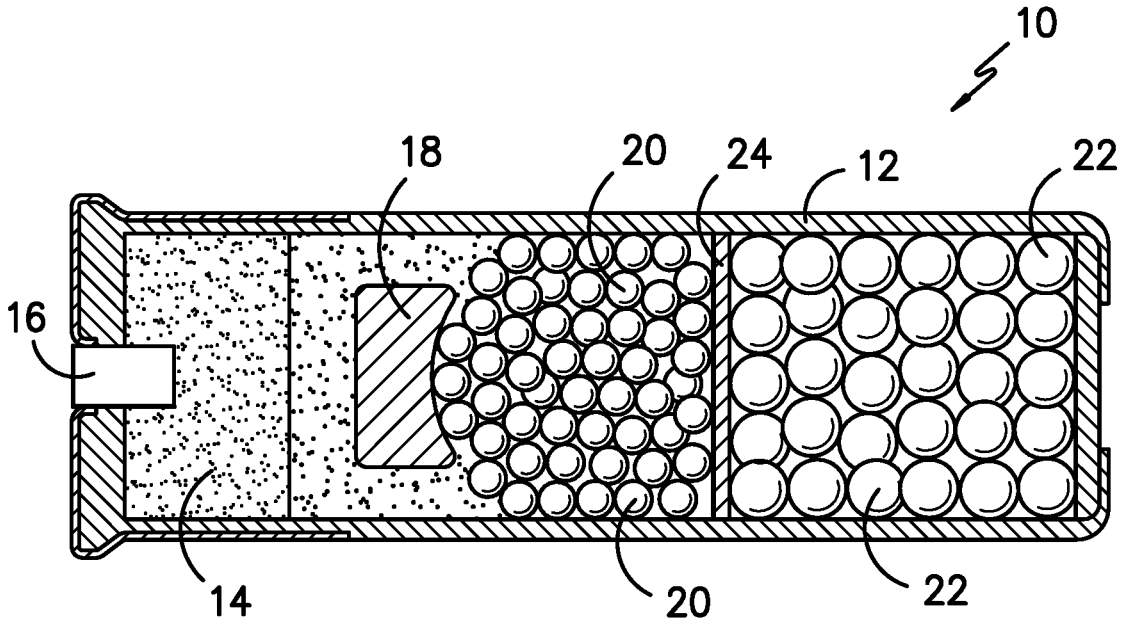
FIG. 3 is a cross sectional view along the lines 3-3 of FIG. 1, wherein the shot shell includes a hull, a primer, gunpowder, a wad, smaller shot pellets positioned adjacent the wad, a spacer, and larger shot pellets adjacent the spacer, wherein the larger shot pellets exit the hull before the smaller shot pellets when the shot shell is fired.

TPS wads 18 are commonly available from manufacturers such as Ballistic Products, Inc. Shotshell wads 18 fill extra space in the hull 12 to make sure the cartridge components are packed tightly within the hull 12 so that there is no room for the shot 20, 22 and powder 14 to move around. Wads 18 also act as a barrier between the powder 14 and shot charges to ensure proper powder ignition, protect the shot 20, 22 from hot gasses and seal gasses behind the shot 20, 22 so that it can be propelled down a weapon barrel. The wad 18 also acts as a dual barrier to protect the barrel from becoming damaged by hard shot 20, 22 and to protect soft shot 20, 22 from becoming deformed by contact with hard barrel steel. In a preferred embodiment, a cupped wad 18 design is used, as shown in FIGS. 2-4, because the cupped design enhances uniformity, accuracy and velocity of the shot pellets 20, 22 at longer distances.

The terms 'smaller shot' 20 or 'small shot' 20 herein may mean #3 size shot or #4 size shot pellets, and 'larger shot' 22 or 'large shot' 22 may mean #1 size shot or #2 size shot pellets. It should be understood, however, that other sizes of shot may be used, so long as 40% to 60% of the shot has a larger size than the remainder of the shot packed into the hull 12, and the specific meaning of 'small shot' or 'smaller shot' simply means that the shot pellets are smaller than 'large shot' or 'larger shot.' In a preferred range, the larger shot 22 comprises 45% to 55% of the total shot 20, 22 in the hull 12, with the smaller shot 20 comprising the remaining total shot in the hull. Even more preferably is a 50% mix of smaller shot 20 and larger shot 22, as shown in FIGS. 2-4. Various types of shot 20, 22 may be used, including lead, tungsten, steel, bismuth and any other type of shot that is suitable for a shot shell 10, although steel shot is preferred. Generally round shot 20, 22 is preferred, although shot pellets 20, 22 having other shapes may be employed, including shot having a ridge around an equatorial line of the otherwise round shot, as is commonly known in the art.

As shown in FIG. 24, the shot shell 10 includes a hull 12 or cartridge having a first end, which includes the primer 16, and a second end, which is open during loading, and then is crimped or otherwise closed or capped off after loading the components into the hull 12 in order to maintain the payload (shot pellets 20, 22) and other components within the hull 12. In one embodiment, the smaller shot 20 is loaded first through the second end, and then the larger shot 22 is loaded after the smaller shot, as shown in FIGS. 2 and 3. In this way, the payload is stratified between smaller shot 20 and larger shot 22. This arrangement provides for the larger shot 22 to exit the hull 12 first, when the shot shell 10 is fired, followed by the smaller shot 20. Optionally, a spacer 24 may be placed between the smaller shot 20 and the larger shot 22 within the hull 12, as shown in FIG. 3, in order to maintain separation between shot 20, 22 of different sizes (and/or shapes).

Figure 4:
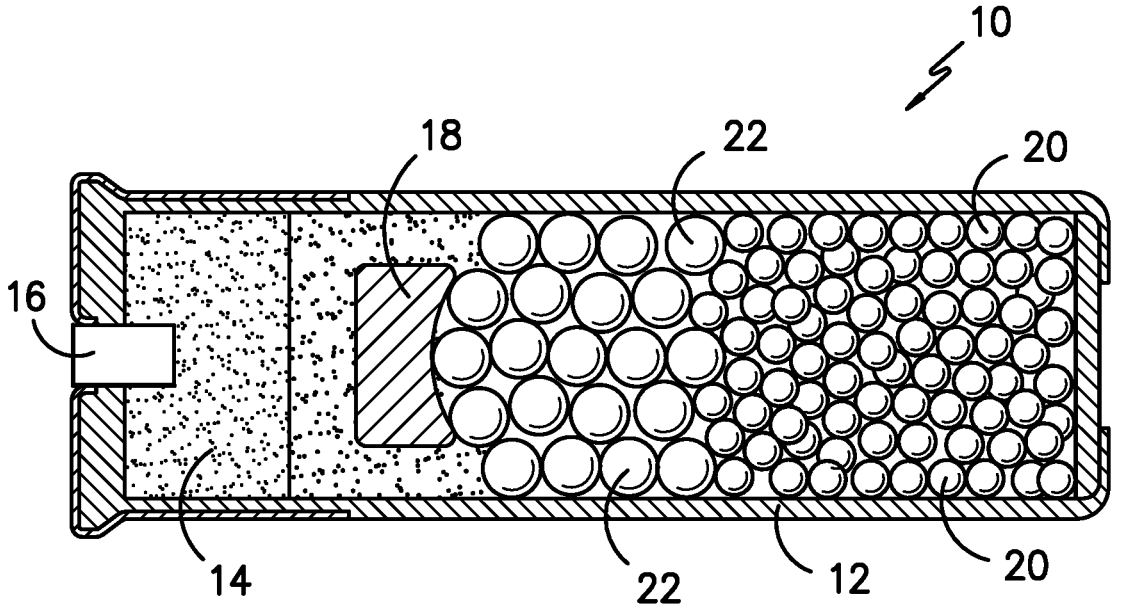
FIG. 4 is a cross sectional view along the lines 4-4 of FIG. 1, wherein the shot shell includes a hull, a primer, gunpowder, a wad, larger shot pellets positioned adjacent the wad, and smaller shot pellets adjacent the larger shot pellets, wherein the smaller shot pellets exit the hull before the larger shot pellets when the shot shell is fired.

In another embodiment, the larger shot 22 may be added to the hull 12 first, followed by the smaller shot 20, as shown in FIG. 4. If necessary or desired, a spacer 24 may be used in this configuration, as well, in order to maintain separation between shot 20, 22 of different sizes.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A shot shell comprising:

a hull having a first end and a second end;

a primer disposed at said first end of said hull;

ball propulsion powder disposed within said hull adjacent said primer;

wadding disposed adjacent said powder within said hull;

shot having a first size disposed adjacent said wadding;

shot having a second size disposed adjacent said shot having said first size, wherein said shot having a second size is adjacent said second end of said hull; and wherein said shot having said second size comprises between 40% and 60% of a total amount of shot disposed within said hull.

2. The shot shell set forth in claim 1, wherein said first size is smaller than said second size.

3. The shot shell set forth in claim 1, wherein said wadding is a tungsten propulsion system wadding.

4. The shot shell set forth in claim 3, wherein said tungsten propulsion system wadding includes a cupper configuration.

5. The shot shell set forth in claim 1, wherein said shot having said second size comprises between 45% and 55% of a total amount of shot disposed within said hull.

6. The shot shell set forth in claim 1, wherein said shot having said second size comprises 50% of a total amount of shot disposed within said hull, and said shot having said first size comprises 50% of said total amount of shot disposed within said hull.

7. The shot shell set forth in claim 1, wherein said shot is made from material selected from the group consisting of lead, tungsten, and steel.

8. The shot shell set forth in claim 1, wherein said second end of said hull is crimped.

9. The shot shell set forth in claim 1, wherein said first size is larger than said second size.

10. The shot shell set forth in claim 1, wherein said shot having said first size is selected from the group consisting of #3 shot and #4 shot.

11. The shot shell set forth in claim 10, wherein said shot having said second size is selected from the group consisting of #1 shot and #2 shot.

* * * * *